US008627951B2

(12) United States Patent
Buse et al.

(10) Patent No.: US 8,627,951 B2
(45) Date of Patent: Jan. 14, 2014

(54) PACK FOR LUMP-FORM OR GRANULAR MATERIAL

(75) Inventors: Henry Buse, Visselhövede (DE); Gisbert Engel, Luttum (DE); Viktor Hein, Luttum (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 384 days.

(21) Appl. No.: 12/664,940

(22) PCT Filed: Jun. 12, 2008

(86) PCT No.: PCT/EP2008/004714

§ 371 (c)(1),
(2), (4) Date: May 25, 2010

(87) PCT Pub. No.: WO2009/000427

PCT Pub. Date: Dec. 31, 2008

(65) Prior Publication Data

US 2010/0230303 A1 Sep. 16, 2010

(30) Foreign Application Priority Data

Jun. 28, 2007 (DE) ..... 10 2007 030 267

(51) Int. Cl.

| | |
|---|---|
| ***A24F 15/00*** | (2006.01) |
| ***B65D 85/10*** | (2006.01) |
| ***B65D 85/12*** | (2006.01) |

(52) U.S. Cl.
USPC ..... 206/265; 206/242; 206/267; 206/268

(58) Field of Classification Search
USPC ..... 206/265, 259, 262, 263, 242, 264, 266, 206/267, 271–276
See application file for complete search history.

(56) References Cited

U.S. PATENT DOCUMENTS

| | | | | |
|---|---|---|---|---|
| 4,852,734 | A * | 8/1989 | Allen et al. | 206/273 |
| 5,145,091 | A * | 9/1992 | Meyers | 221/45 |
| 5,366,077 | A * | 11/1994 | Pham | 206/268 |
| 6,164,444 | A * | 12/2000 | Bray et al. | 206/268 |
| 2003/0047470 | A1 | 3/2003 | Parker | |
| 2005/0236283 | A1 | 10/2005 | Ito | |

FOREIGN PATENT DOCUMENTS

| | | |
|---|---|---|
| DE | 9320872 | 10/1993 |
| DE | 1760868 | 9/1995 |
| DE | 21 2004 000 001 | 12/2003 |
| FR | 2238640 | 3/1975 |

(Continued)

OTHER PUBLICATIONS

Japanese Patent Office Action on related case—2010-513713—(Oct. 26, 2012).

(Continued)

*Primary Examiner* — Luan K Bui
*Assistant Examiner* — Rafael Ortiz
(74) *Attorney, Agent, or Firm* — Laurence P. Colton; Smith Risley Tempel Santos LLC

(57) ABSTRACT

A pack for in particular piece-form pack contents having a sealed inner pack (11) with removal opening (21) and closure flap (24), an outer pack (10) with box part or base part (27) and movable closure part (28), and a covering part (12) between the inner pack (11) and outer pack (10), the covering part (12) having an opening or a window (55) in the region of the removal opening (21) of the inner pack (11).

13 Claims, 9 Drawing Sheets

(56) References Cited

FOREIGN PATENT DOCUMENTS

| | | | |
|---|---|---|---|
| JP | 2010513713 | A | 7/1967 |
| JP | 4226344 | A | 8/1992 |
| JP | 2001524429 | A | 12/2001 |
| JP | 2002519261 | A | 7/2002 |
| JP | 2005519823 | A | 7/2005 |
| JP | 2006001612 | A | 1/2006 |
| JP | 2006001614 | A | 1/2006 |
| WO | WO 2005/082738 | | 9/2005 |
| WO | 2006043496 | A1 | 4/2006 |

OTHER PUBLICATIONS

Studio Torta, Remarks Concerning the Patentability of European Patent Application 08759210.1According to Art. 115 EPC, Feb. 13, 2013, Munich, Germany.

* cited by examiner

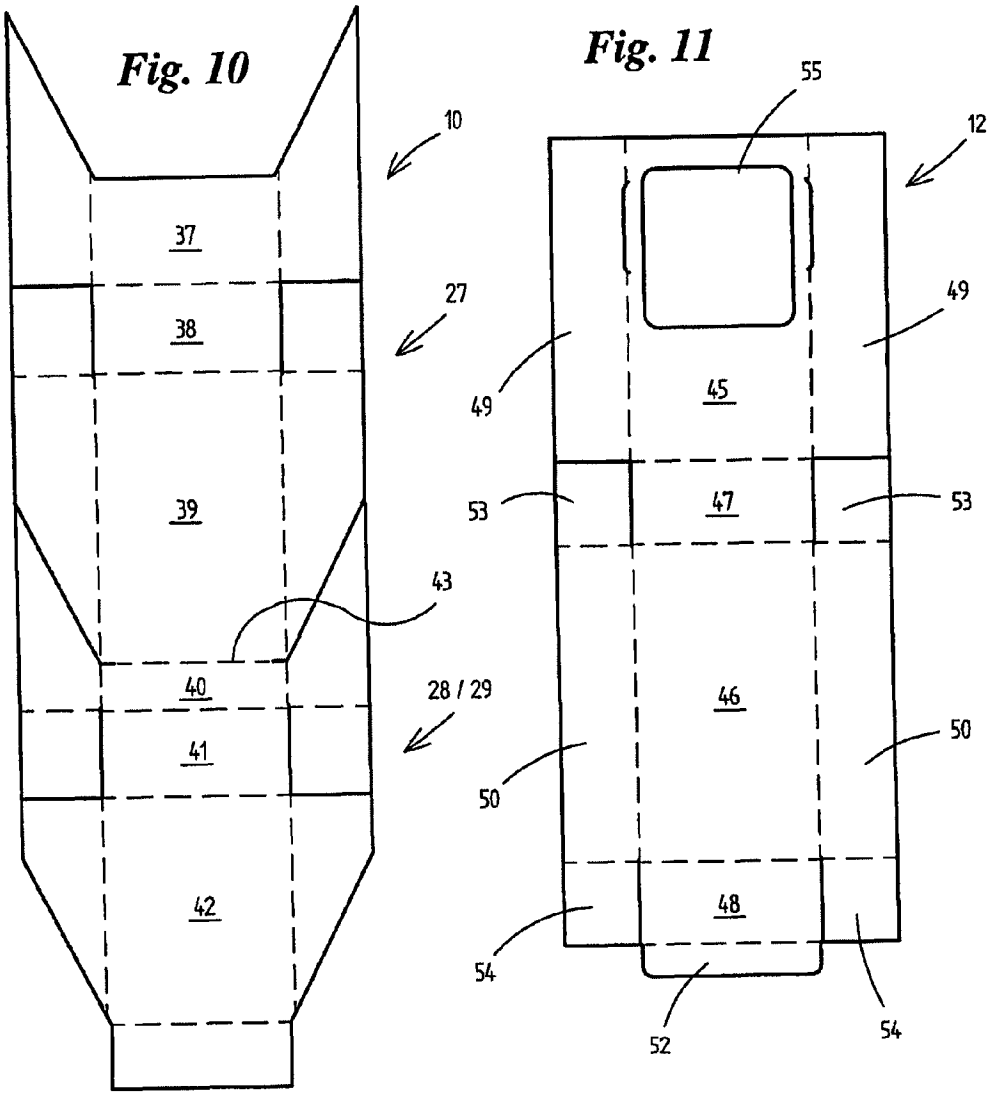
Fig. 11
Fig. 10
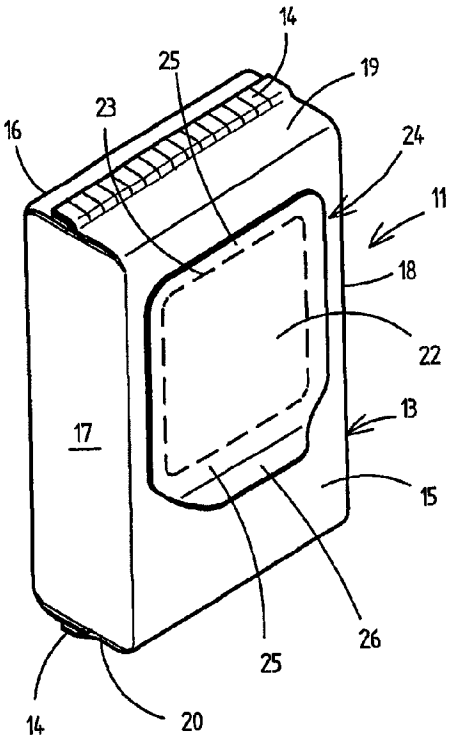
Fig. 9

PACK FOR LUMP-FORM OR GRANULAR MATERIAL

STATEMENT OF RELATED APPLICATIONS

This patent application claims the benefit of and is the United States Chapter II National Phase of Patent Cooperation Treaty International Application No. PCT/EP2008/004714 having International Filing Date 12 Jun. 2008, which is based on and claims the benefit of German Patent Application No. 10 2007 030 267.5 having a filing date of 28 Jun. 2007, both of which are incorporated herein in their entireties by this reference.

BACKGROUND OF THE INVENTION

The invention relates to a pack made of (thin) cardboard or similar packaging material for accommodating piece-form or granular pack contents, in particular chewing tobacco or chewing-tobacco substitute, so-called snus portions.

BRIEF SUMMARY OF THE INVENTION

The pack should be user friendly for the intended application area. Furthermore, it is sought to provide a higher level of sealing for the pack in relation to losses in respect of moisture and flavor. It should also be possible for the pack to be produced with low material outlay on high-performance packaging machines.

Accordingly, it is an object of the invention to propose differently embodied packs which meet the above requirements.

In order to achieve this object, the pack according to the invention is characterized by the following features:

a) an outer pack comprises at least a base part or box part and a pivotable and/or displaceable closure part or lid, b) an insert or covering part comprising a separate blank is arranged in the outer pack for the purpose of partially enclosing an interior of the outer pack, c) the covering part extends at least along a front side or a removal side of the outer pack, the removal side of the outer pack being at least partially covered by the covering part, d) a front side of the covering part, this front side then being directed towards the removal side of the outer pack, in other words a covering front wall, has an opening or an aperture which is closed all the way round or a window for the removal of pack contents from the outer pack.

According to an independent alternative, the outer pack has arranged in it an inner pack which is made of sheet material or the like, is closed all the way round and accommodates the pack contents. The inner pack has a removal opening which can be closed by a pull-off closure flap, is arranged in the region of the aperture or of the window of the covering part and can thus be actuated when the outer pack is open.

Two basic concepts are envisaged for the outer pack: in the case of a first embodiment, the pack contents are arranged directly in the outer pack and, in the region of the closure side, are covered merely by the covering part with window for the removal of the contents. In the case of the alternative, the pack contents are arranged in a preferably closed inner pack and the latter is inserted into the outer pack, likewise having a covering part with window, which is provided in the region of a removal opening of the inner pack.

In the simplest embodiment, the covering part, which comprises a separate blank, is a collar of a pack of the hinge-lid-box type. A covering part is advantageously provided at least with a covering front wall which covers a front side or the removal side of the outer pack over the entire surface area and has a window at a suitable location for the removal of the pack contents when the outer pack is open. The covering part may also be designed such that it completely encloses the inner pack or the interior of the outer pack, that is to say it forms an independent pack which is closed predominantly or all the way round.

BRIEF SUMMARY OF THE DRAWINGS

Further details relating to construction, handling and production of the packs can be gathered from the following description for the exemplary embodiments illustrated in the drawings, in which:

FIG. 9 shows the pack contents for the pack according to FIGS. 6 and 7, FIG. 10 shows a spread-out blank for the pack according to FIG. 6, FIG. 11 shows a blank for a covering part or a covering sheath of the pack contents, in the non-folded state.

DETAILED DESCRIPTION OF PREFERRED EMBODIMENTS

Figures 1, 2:
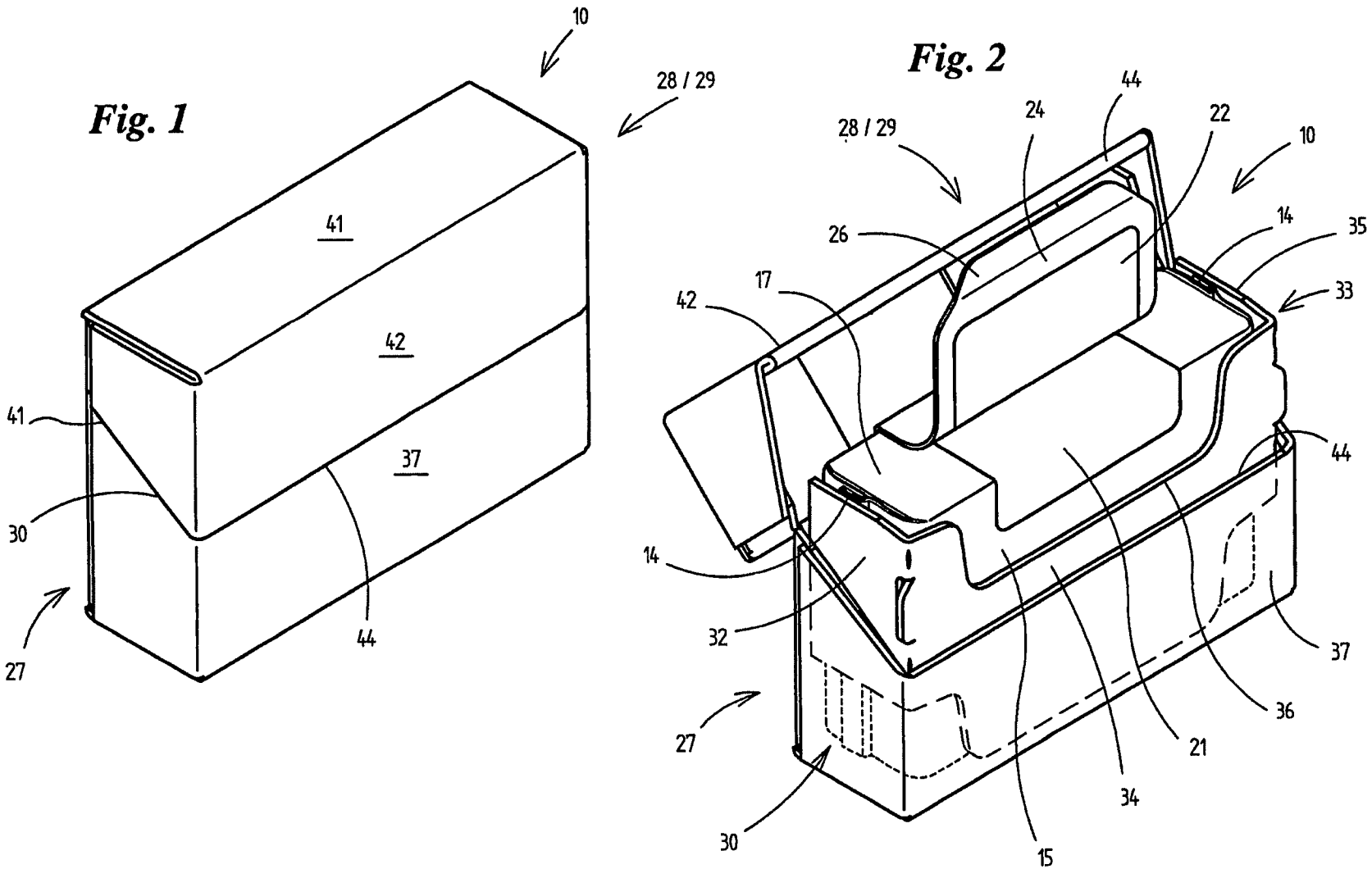
FIG. 1 shows a perspective illustration of a hinge-lid box, as an exemplary embodiment of an outer pack, in the closed position.
FIG. 2 shows a perspective illustration of a pack according to FIG. 1 with the lid open.
Figure 4:
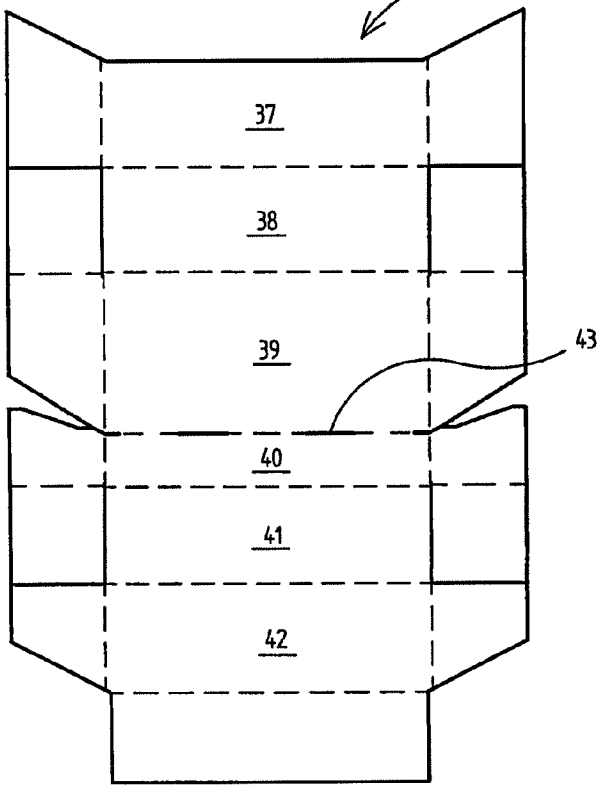
FIG. 4 shows a spread-out blank of an (outer) pack according to FIG. 1.
Figure 3:
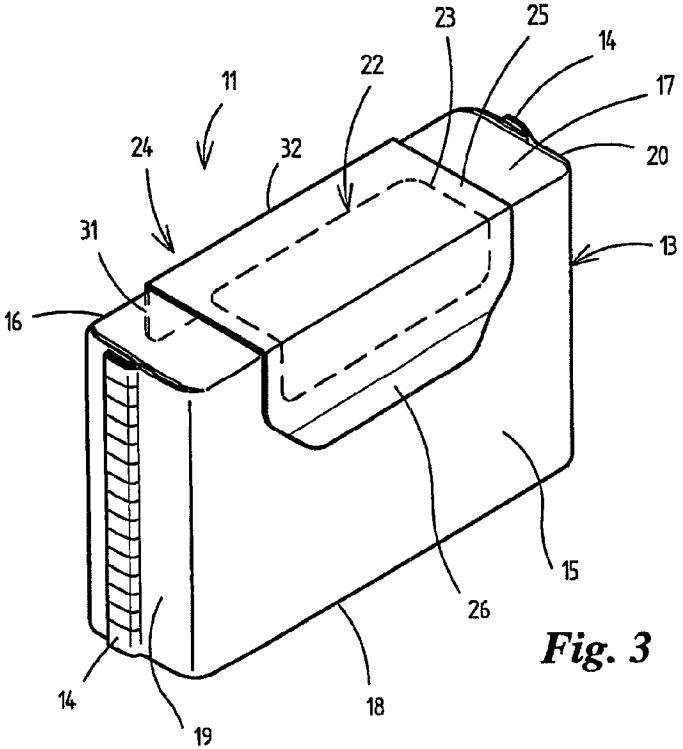
FIG. 3 shows a perspective illustration of an inner pack as pack contents, namely of a (tubular) bag made of sheet material.
Figure 5:
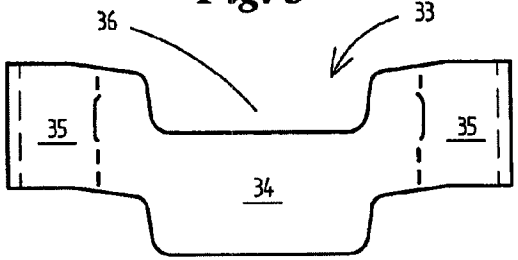
FIG. 5 shows a blank for a collar as part of the pack according to FIG. 1.
Figure 8:
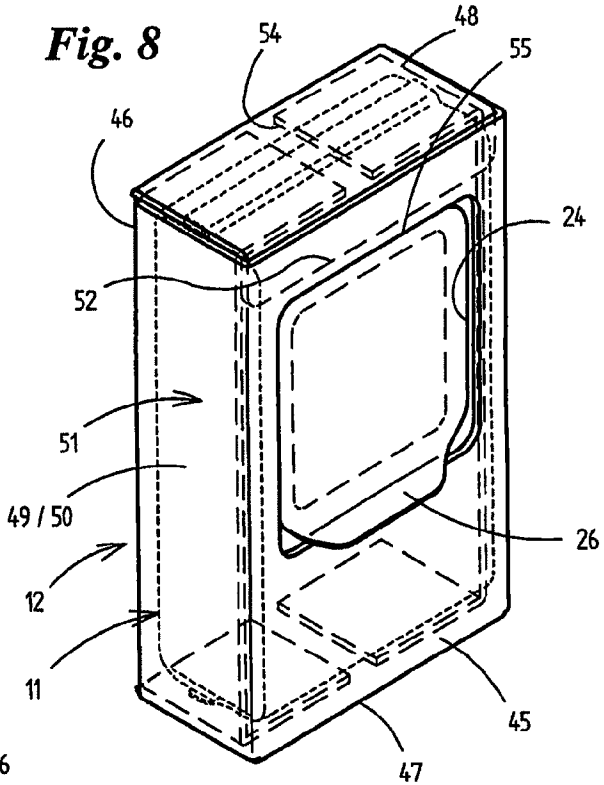
FIG. 8 shows a perspective illustration of the pack contents with a folded covering sheath.
Figure 7:
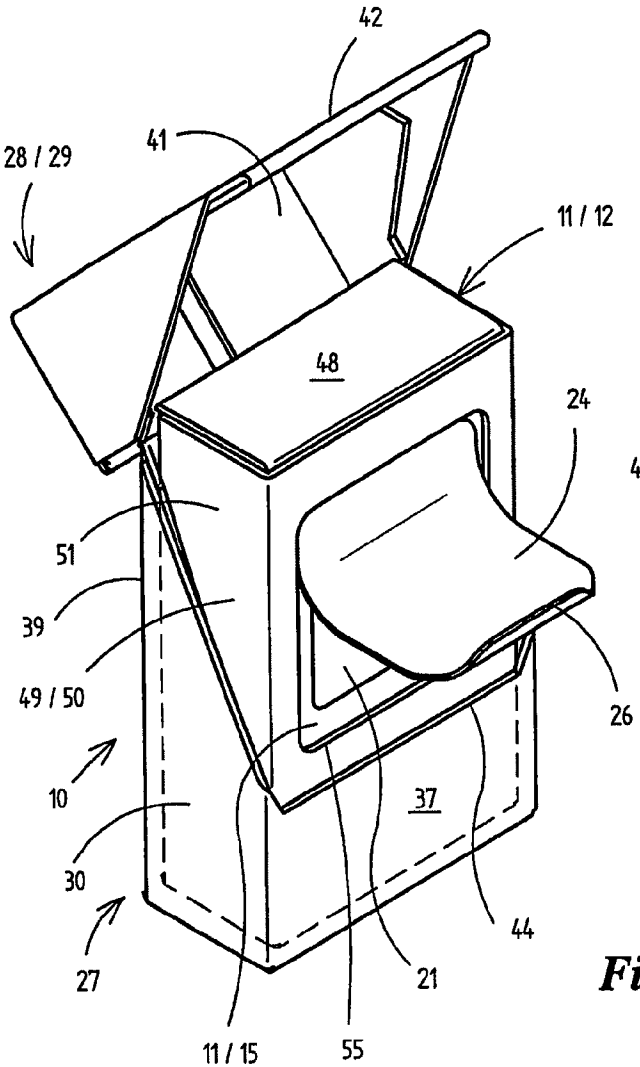
FIG. 7 shows a perspective illustration of the pack according to FIG. 6 with the lid open.

The packs illustrated as exemplary embodiments are intended preferably for accommodating piece-form pack contents, in particular for accommodating pieces of chewing tobacco (snus).

The differently configured exemplary embodiments all comprise an outer pack 10 and a covering part 12 which is made of a separate blank and is arranged in the outer pack 10 at least on the front side, that is to say in the region of a pack front side or in the region of an open side. The outer pack 10 and covering part 12 preferably consist of (thin) cardboard. The covering part 12 may be designed in various ways, in the simplest embodiment as a front collar (in the case of a hinge-lid box), but preferably as a three-dimensional folded structure which fills an interior of the outer pack 10. The covering part 12 is preferably provided at least with a covering wall or covering front wall which covers an interior of the outer pack 10 and has an aperture or a window for access to the interior of the outer pack 10. The aperture or the window serves for the removal of the pack contents.

The pack contents may be arranged directly in the outer pack 10 or within the covering part 12, which is folded as an inner part of the outer pack 10. As an alternative, an inner pack 11 is provided to accommodate the pack contents. The inner pack 11 may be designed in various ways. In the case of the present exemplary embodiments, the inner pack 11 comprises a sealed sheet-material bag 13 embodied as a tubular bag with mutually opposite closure seams 14. The latter are designed as fin seams. The inner pack 11, which is more or less cuboidal, is preferably dimensioned so as to more or less completely fill an interior of the outer pack 10. The inner pack 11 has a large-surface-area inner front wall 15 and a correspondingly designed inner rear wall 16 located opposite. These walls are connected to one another by elongate, relatively narrow inner side walls 17, 18. Furthermore, the inner pack 11 is bounded by transversely directed inner end walls 19, 20, the closure seams 14 being formed in the region thereof.

For the removal of the pack contents, the inner pack 11 or the sheet-material bag 13 has a removal opening 21. The latter is likewise sealed closed in its original state, to be precise by an opening piece 22 of the material of the inner pack 11. The opening piece 22 is bounded by a weakening line which runs preferably all the way round, in this case by a closed perforation line 23. In order to create the removal opening 21, the opening piece 22 is severed from its connection to the sheet material of the inner pack 11.

In order to open the inner pack 11 for the first time, and for repeated opening and reclosure, a closure flap 24 is fitted on the outside of the inner pack 11. This closure flap comprises a separate blank, preferably likewise made of a sheet material. The closure flap 24 is connected to the inner pack 11 by adhesive bonding, in particular by full-surface-area adhesive bonding, in the region of the removal opening 21. The opening piece 22 is completely covered by the closure flap 24, to be precise with the formation of a lateral strip-like overlap 25 running preferably all the way round. A grip tab 26 is formed on a periphery of the closure flap 24 which is selected for the easy opening of the inner pack 11. This grip tab is a tongue-like peripheral region of the closure flap 24 and is preferably free of adhesive. For the purpose of opening the inner pack 11 by virtue of the closure flap 24 being pulled off, the grip tab 26 of the latter is gripped. The closure flap 24 is pulled off from the inner pack 11 by being pulled upward. When the pack is opened for the first time, the opening piece 22 is pulled away from its connection to the wall of the inner pack 11. For reclosure, the closure flap 24 is pressed onto the inner pack 11, wherein the lateral overlaps 25, on account of a permanent adhesive, are reconnected to a peripheral region of the inner pack 11 which encloses the removal opening 21.

The position and dimensioning of the removal opening 21 and of the closure flap 24 are geared to the embodiment of the outer pack 10 and of the covering part 12, to be precise such that the closure flap 24 can be used, in particular by virtue of the grip tab 26 being gripped, in an open position of the outer pack 10. The outer pack 10 and inner pack 11 as well as the covering part 12 are coordinated with one another in respect of dimensioning, but also in functional terms, that is to say in design terms. The outer pack 10 basically comprises a base part or box part 27 and a closure part 28, which is designed predominantly as a lid 29.

In the case of the exemplary embodiment according to FIGS. 1 to 5, the outer pack 10 is a specially proportioned hinge-lid box of known construction. A lid 29 is fitted integrally, as the closure part, on a box part 27 at the bottom. The inner pack 11 (FIG. 3) is fitted in the hinge-lid box, to be precise such that the closure seams 14 of the sheet-material bag 13 are directed sideways, that is to say are directed toward narrow, upright side walls 30 of the outer pack 10. Accordingly, the closure seams 14 are concealed within the pack.

In the case of this exemplary embodiment of the inner pack 11, the removal opening 21 extends "around the corner", that is to say in a region of the inner front wall 15 and upwardly directed, adjacent inner side wall 17. Consequently, the closure flap 24 likewise extends in the region of the inner front wall 15, and of the inner side wall 17 and terminates with a connecting strip 31 on the inner rear wall 16. The closure structure of the inner pack 11, overall, is exposed when the lid 29 is open (FIG. 2). The closure flap 24 can be gripped, and opened, by the grip tab 26. The closure flap 24, which is fixed by adhesive bonding, is released from the inner pack 11 here preferably as far as an edge 32 directed toward the bag rear wall 16, the removal opening 21 being exposed in the process. The closure flap 24 remains connected to the inner pack 11.

The covering part 12 of this exemplary embodiment of the outer pack 10 is designed as a collar 33 with a collar front wall 34 and collar side tab 35. The closure seams 14 of the sheet-material bag 13 butt, at least in a top region, against the collar side tab 35. On the front side, the removal opening 15 extends, in the region of the bag front wall 34, into a collar depression 36, which is formed on the collar front wall 34 and in the region of which the grip tab 26 is also exposed, that is to say can be gripped.

A blank (FIG. 4) for the outer pack 10 according to FIGS. 1 and 2 comprises, in a known manner, successive regions for a box front wall 37, base wall 38, box rear wall 39, lid rear wall 40, end wall 41 and lid front wall 42. The lid rear wall 40 and box rear wall 39 are connected to one another by a linear articulation 43. The wall regions of the blank are dimensioned such that the box front wall 37 and lid front wall 42 have approximately the same dimensions. A separating line 44 between the box part 27 and lid 29 is arranged approximately halfway up the outer pack 10.

It is also the case in the exemplary embodiment according to FIGS. 6 to 11 that the outer pack 10 is designed as a hinge-lid box. The box part 27 and lid 29 are designed in a manner comparable to those of the exemplary embodiment above. The outer pack 10 is cuboidal, to be precise with proportions which are largely conventional for cigarette packs of this type. In order to facilitate access to the pack contents or to the inner pack 11, there is a special feature in respect of the proportions. The lid front wall 39 is of comparatively large dimensioning in the longitudinal direction of the pack, and at any rate is significantly larger or higher than the box front wall 37. The lid front wall 42 is preferably double the height of the box front wall 37. As a result, a correspondingly large part of the pack contents is exposed on the front side when the lid 29 is open.

The rectangular inner pack 11 with sheet-material bag 13 is arranged in the outer pack 10 of this exemplary embodiment such that the closure seams 14 are directed upward and downward. The removal opening 21 here is positioned entirely in the region of the inner front wall 15, to be precise at a spacing apart from inner side walls 17, 18 and from the inner end walls 19, 20 with the closure seams 14. The removal opening 21 is positioned eccentrically in a top region of the inner pack 11, to be precise at a spacing above the box front wall 37. The removal opening 21 is covered by a closure flap 24 which extends entirely and exclusively in the region of the inner front wall 15. The closure flap 14 is dimensioned such that it covers over the removal opening 21 in full and is connected, by way of an all-round periphery, to the inner front wall 15 outside the removal opening 21. A grip tab 26 is arranged on the bottom periphery of the closure flap 24.

In the case of this exemplary embodiment, the covering part 12 is designed in a particular manner, that is to say as an intermediate pack, preferably made of thin cardboard. A blank (FIG. 11) for the covering part 12 is designed such that the inner pack 11 is completely enclosed by the blank of the covering part 12. The covering part 12 has a covering front wall 45, a covering rear wall 46, a covering base 47, a covering end wall 48 and covering side tabs 49, 50 for forming covering side walls 51. The covering end wall 48 is provided with a connecting flap 52 which, when the covering part 12 is in the completed state, is connected on the inside by adhesive bonding to a top peripheral region of the covering front wall 45. Corner tabs 53, 54 in extension of the covering side tabs 50 lie against the inside of the covering base 47 and of the covering end wall 48 and are preferably connected thereto. This gives rise to a dimensionally stable unit made up of the inner pack 11 and covering part 12 as pack contents for the outer pack 10. In the case of this exemplary embodiment, the blank for the covering part 12 is designed in accordance with the principle of longitudinal folding or base folding, in the case of which the covering front wall 45, covering base 47 and covering rear wall 46 follow one after the other in the longitudinal direction of the blank. The blank may also be designed analogously in accordance with the principle of the transverse folding.

Figure 6:
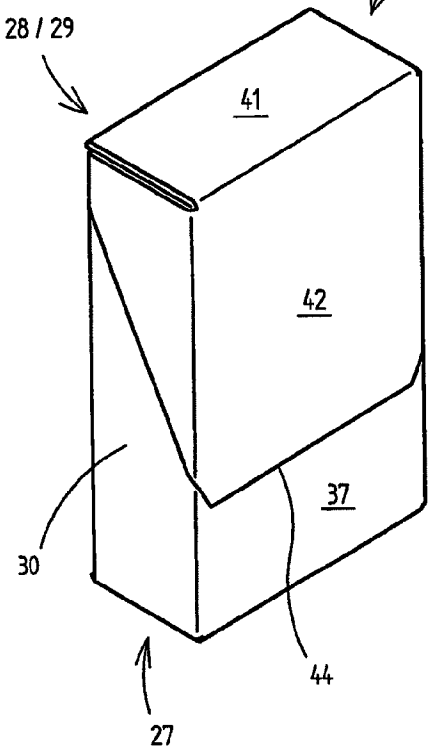
FIG. 6 shows a perspective illustration of a pack likewise embodied as a hinge-lid box, with the lid closed.

The covering part 12 is provided with an aperture or a window 55 in the region of the removal opening 21 of the inner pack 11, that is to say, in this case, in the region of the covering front wall 45. The window 55 is dimensioned such that the closure flap 24 for the removal opening 21 is exposed overall in the region of the covering front wall 45. Arrangement and dimensioning are advantageously such that the grip tab 26 at least has a sub-region butting against the covering front wall 45 outside the window 55 and can thus easily be gripped. When the pack is in the complete state, the grip tab 26 is located in a region between a bottom periphery of the window 55 and a free edge of the box front wall 37. When the lid 29 is closed, the closure mechanism of the inner pack 11 is completely concealed (FIG. 6).

Figure 13:
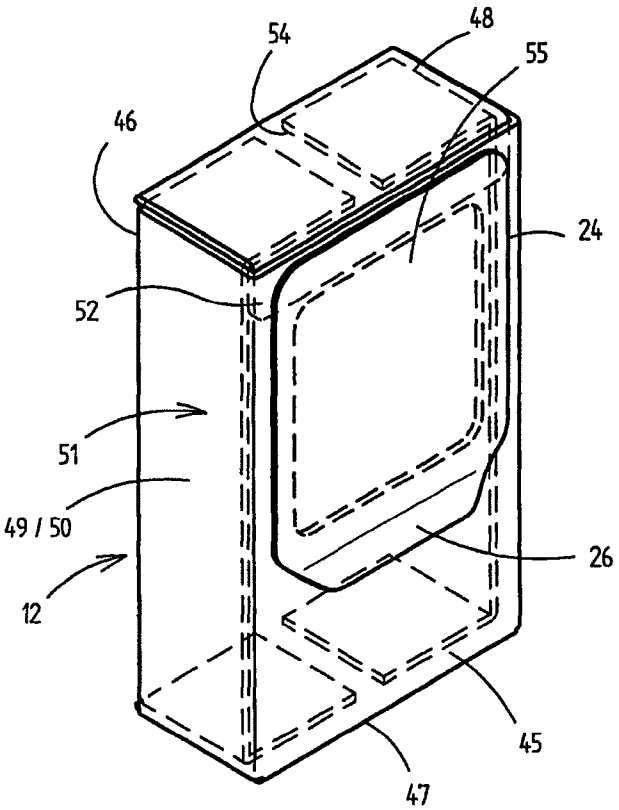
FIG. 13 shows a perspective illustration of a covering sheath as an inner part of a pack according to FIG. 12.
Figure 12:
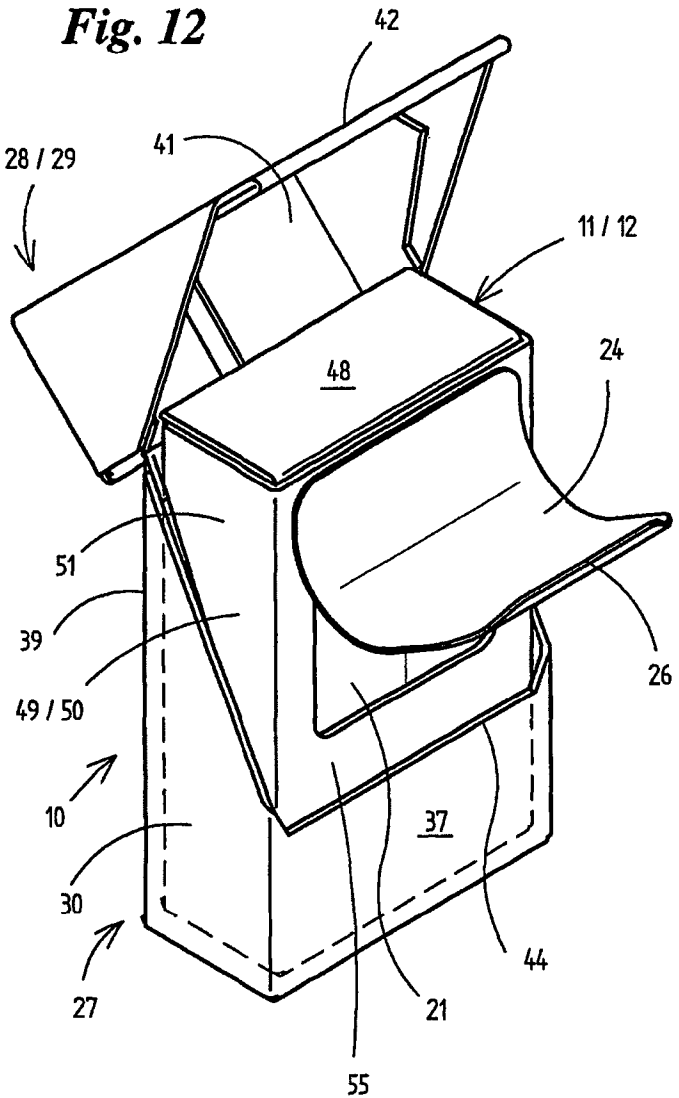
FIG. 12 shows a modified embodiment of the pack according to FIGS. 6 and 7 with the lid open.

A modified embodiment of the pack as a whole is illustrated in FIGS. 12 and 13. The outer pack 10 is designed in the same way as for the exemplary embodiment according to FIGS. 6 and 7. Furthermore, the covering part 12 is designed as a pack inner part which is closed all the way round and can be fitted into the outer pack 10. In the case of this exemplary embodiment, there is no inner pack 11 or sheet-material bag 13 for accommodating the pack contents. The pieces which form the pack contents are arranged directly in the covering part 12, the latter acting like an inner pack.

In the case of this variant, the window 55, which is arranged on the covering front wall 45, may be open or, as is shown, covered by a closure flap 24. The latter is fitted in this case on the outside of the covering part 12, that is to say it is fixed thereon by adhesive bonding, in particular by permanent adhesive. The closure flap 24 is dimensioned such that it covers the window 55, including an overlap 25 preferably running all the way round. The grip tab 26 is directed downward, but is exposed when the lid 29 is open. When the pack is opened for the first time, the closure flap 24 can be pulled off altogether or can be fixed in the region of a connecting strip directed toward the covering end wall 48.

A special pack for piece-form pack contents is illustrated in FIGS. 14 to 24. The outer pack 10 comprises two pack parts which can be displaced relative to one another, namely a relatively small base part 27 and a larger, displaceable closure part 28. These pack parts are divided from one another by a separating line 56 running all the way round. The base part 27 and closure part 28 are formed from a common blank, for example in the embodiment according to FIG. 20. This blank is severed along the separating line 56 when the pack is opened for the first time by the user or during production of the pack, the separating line being designed within the blank, in part, as the severing cut going all the way through the blank and, in part, as a perforation line.

The base part 27 comprises the box front wall 37, base wall 38 (which, depending on the position of the pack, may also be directed upward) and box rear wall 39. Side tabs and corner tabs are designed, that is to say dimensioned, in a particular way. The box front wall 37 has arranged on it, on both sides, outer tabs 57, 58 which, in respect of the transverse dimensions, correspond to the width of side walls 30 of the outer pack 10. Inner tabs 59, 60 of different widths are provided laterally on the box rear wall 39. An inner tab 59 is designed to be of smaller width than, in particular of approximately half the width of, the associated outer tab 57. The inner tab 60 located opposite is designed to be of the same width as the associated outer tab 58. Corner tabs 61, 62 are provided on the inner tabs 59 and 60. These corner tabs are of the same width or transverse dimensioning as the associated inner tabs 59, 60.

Figure 15:
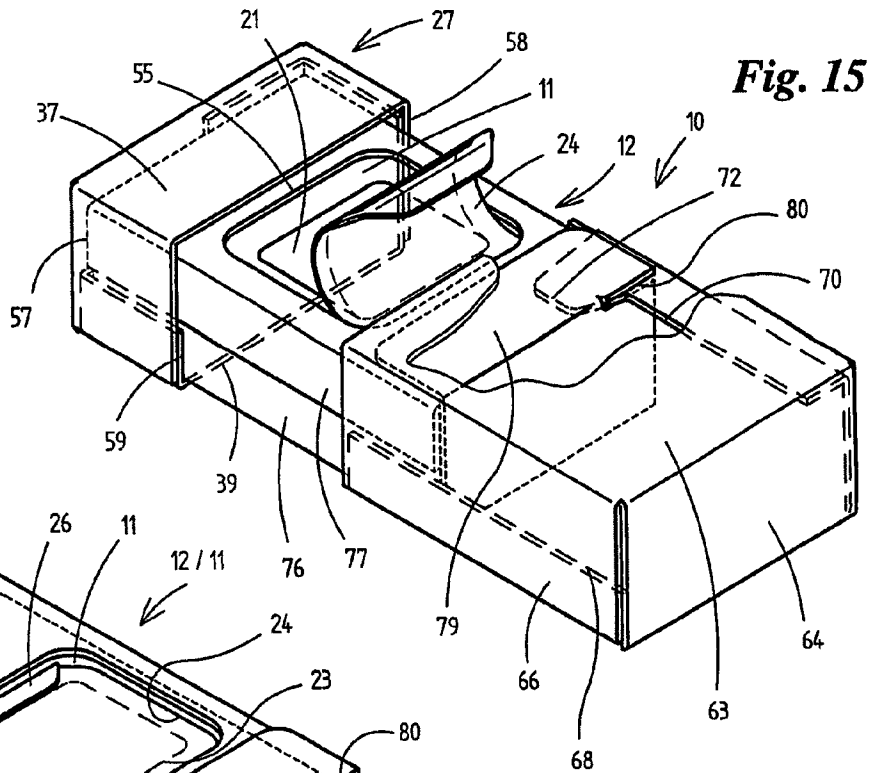
FIG. 15 shows the pack according to FIG. 14 in the open position.
Figure 14:
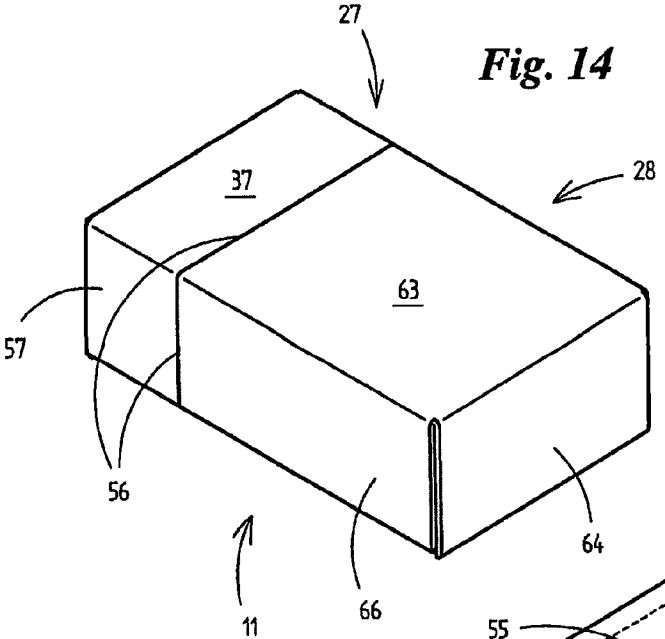
FIG. 14 shows a perspective illustration of a pack with two pack parts which can be displaced in relation to one another.

When the outer pack 10 is in the completed state, the base part 27 is such that, in the region of side walls 30, the folded outer tabs 57, 58 extend over the entire width (FIGS. 14 and 15). On the one side, the inner tab 60 also extends over the entire pack width on the inside of the outer tab 58. Opposite, the inner tab 59 extends only approximately over half the height of the pack on the inside of the outer tab 57. The tabs 57, 59 and 58, 60 are connected to one another in each case by adhesive bonding. The corner tabs 61, 62 butt against the inside of the base wall 38.

The blank part for the closure part 28 comprises a front wall 63, an end wall 64 (which, in an appropriate position, may be the base wall) and a rear wall 65. The latter is connected to the base part 27 via the separating line 56, a perforation line extending merely in the region of the box rear wall 39 and rear wall 65.

Side tabs of the closure part 28 are designed in a particular way. Located opposite one another on the front wall are outer side tabs 66, 67 which extend over the entire length of the front wall 63 and over (approximately) the entire width of the outer pack 10 or of the closure part 28. Side tabs in the region of the rear wall 65 are designed differently from this. On the one side, a narrow inner side tab 68 is provided over the entire length of the rear wall 65. The width of this inner side tab 68 corresponds (approximately) to half the width of the associated outer side tab 66. Opposite, an inner side tab 69 is located on the rear wall 65, this inner side tab 69 being of corresponding design to the side tab 67 in respect of dimensioning. A supplementary tab 70 is arranged on the free side of this inner side tab 69 and delimited by a folding line 71. The supplementary tab 70 is part of means for limiting the relative movements of the closure part 28 of the outer pack 10. For this purpose, a transversely directed nose 72 is provided on the supplementary tab 70 adjacent to the box part or base part 27.

The separating line 56 for dividing the base part 27 from the closure part 28 comprises within the single-piece blank (FIG. 20), in the region of the side tabs 68, 59 and 69, 60, a punch cut 73, that is to say completely severed portion. A perforation line 74 is formed in the region of the rear wall 65 and box rear wall 39.

The covering part 12 or the blank thereof (FIG. 21) is also designed in a particular way. A design in accordance with the transverse-folding principle is selected here. The covering part 12, and thus the blank, is designed such that, with the exception of an end side or inner end wall 19, the pack contents are, that is to say the inner pack 11 is, completely enclosed. In a manner analogous to the exemplary embodiment, the blank comprises the covering front wall 45, covering rear wall 46 and covering base 47. A covering side wall 75 is located between the walls 45 and 46. A folding tab is provided on the free side of the covering rear wall 46 in order to form an opposite covering side wall 76.

The latter is connected to a connecting strip 77, which is provided opposite on the free periphery of the covering front wall, in order to produce a cross-sectionally closed, sleeve-like pack. Base corner tabs 78 butt against the inside of the covering base 47 and are preferably connected thereto. Located on the free side of the covering base is a connecting flap 79 which, when the covering part 12 is in the completed state, is connected to the covering front wall 45. The covering front wall is provided with a window 55 which is preferably approximately square and is positioned approximately centrally in, that is to say halfway up, the covering front wall 45. In the case of this exemplary embodiment, the closure flap 24 is positioned such that the grip tab 26 is assigned to the fixed base part 27. This makes it possible for the removal opening 21 to be actuated even when the closure part 28 is only partially open.

Figure 21:
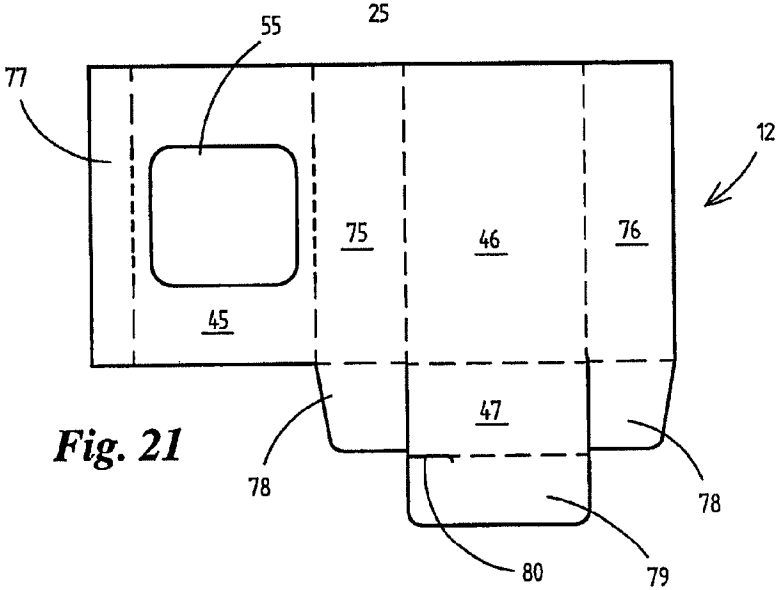
FIG. 21 shows a blank for a covering part or a covering sheath of the pack contents, likewise in the non-folded state.

The blank according to FIG. 21 of the covering part 12 is folded such that the connecting flap 79 of the covering base 47 butts against the top side or outside of the covering front wall 45. The connecting strip 77 is likewise connected to the outside of the covering side wall 76.

Figure 16:
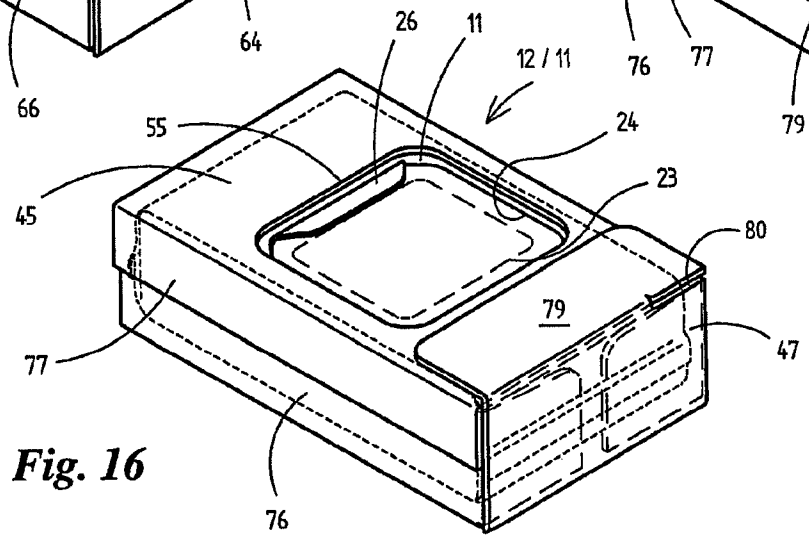
FIG. 16 shows a unit made of pack contents and covering sheath.
Figure 19:
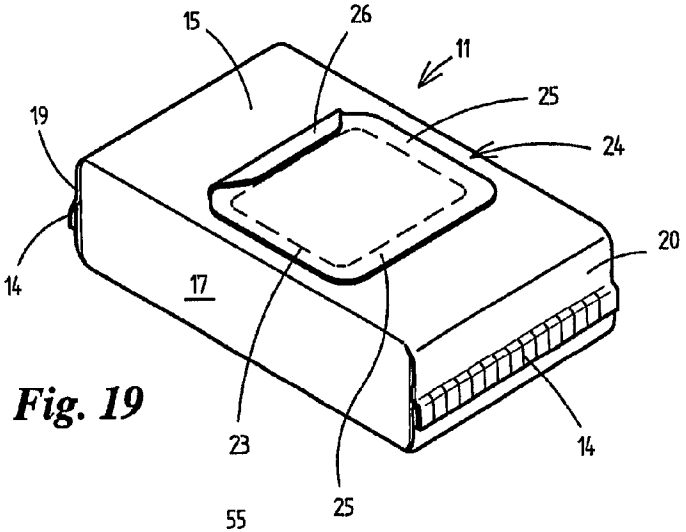
FIG. 19 shows pack contents for the pack according to FIGS. 14 and 15.

The pack may be provided with an inner pack 11 of the embodiment described, or of some other embodiment, for the pack contents. This embodiment is illustrated in FIGS. 15, 16 and 19. The opening mechanism, that is to say the removal opening 21 including the closure flap 24, are arranged approximately centrally in the region of the inner front wall 15 (FIG. 19).

The unit made up of the covering part 12 and inner pack 11 is arranged in the outer pack 10 such that the (open) end side located opposite the covering base wall is assigned to the cup-like base part 27. The covering part 12 is anchored preferably in the base part 27, for example by adhesive bonding. The arrangement is such that the connecting strip 77 resting on the outside is located in the top cross-sectional region of the outer pack 10 and thus approximately in the same plane as the inner tab 59 in the region of the base part 27 and the inner side tab 68 in the region of the closure part 28. Once the base part 27 and closure part 28 have been separated, the latter can be displaced on the covering part 12, that is to say out of a closed position according to FIG. 14 into an open position according to FIG. 15. In this position, the window 55 of the covering part 12 is exposed for actuation of the closure flap 24 or for the removal of articles. The open or end position of the displaceable closure part 28 is preferably secured by stops. In the present case, the blank for the closure part 28 is folded such that the supplementary tab 70 with nose 72 is arranged at the front, that is to say on the inside of the front wall 63 of the closure part 28. The supplementary tab 70, rather than being connected to the wall 63, is free and can thus interact with the covering part 12. In the peripheral region directed towards the same, a punched slot 80 is provided between the connecting flap 79 and covering front wall 45. This slot extends in the region of a folding edge between the covering base 47 and connecting flap 79, to be precise in the region of the supplementary tab 70. The latter passes through the slot 80 during the pushing movements of the closure part 28. In the open position, the nose 72 ends up outside the slot 80, in the region of the folding edge, in abutment against the covering base 47.

Figure 18:
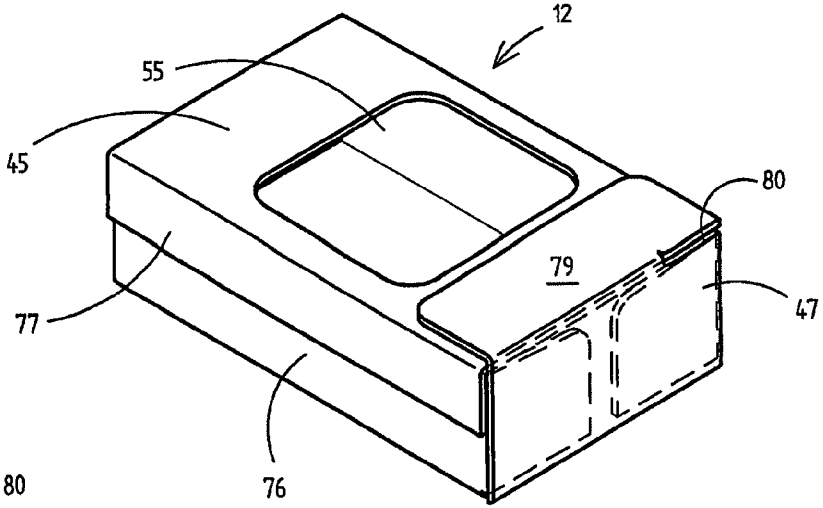
FIG. 18 shows a covering part or a covering sheath as the inner part of the pack according to FIG. 17.
Figure 17:
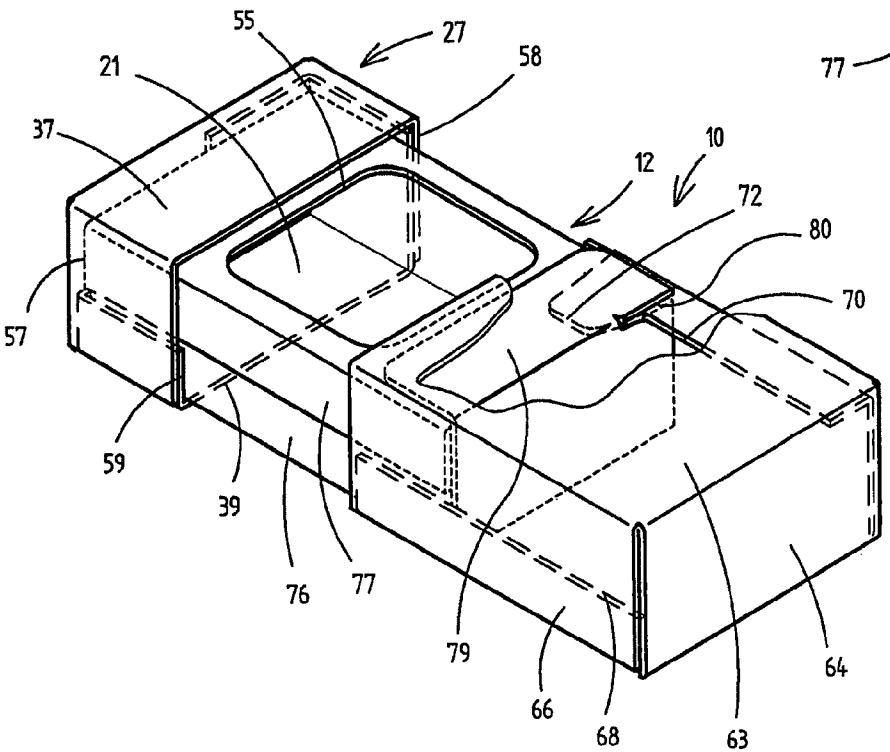
FIG. 17 shows a perspective view of a modified embodiment of the pack according to FIGS. 14 and 15 in the open position.
Figure 20:
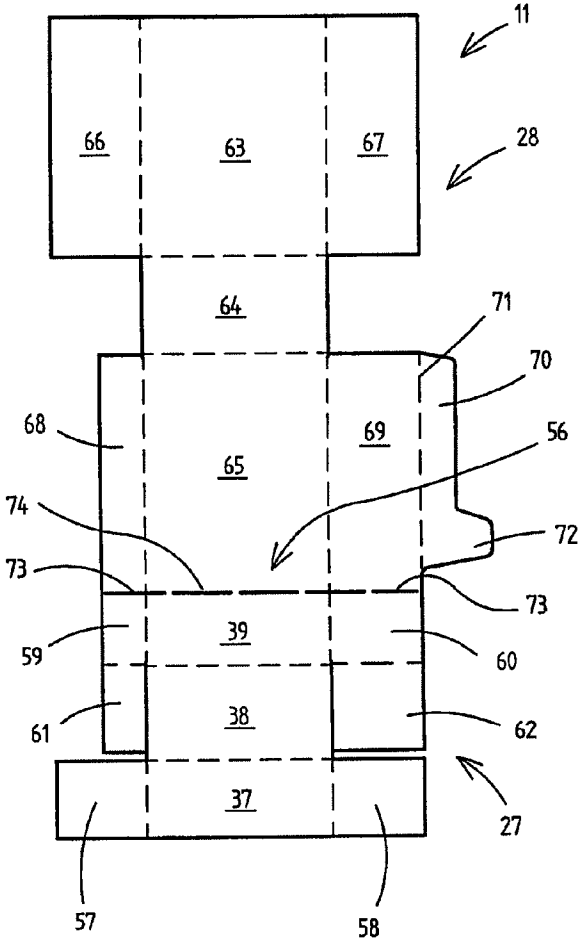
FIG. 20 shows a spread-out non-folded blank for the pack according to FIG. 14.

In the case of this type of pack, dispensing with an inner pack 11, the pack contents can be arranged directly in the inner part, that is to say the covering part 12, it being possible for this covering part to be of the embodiment described (FIG. 21), but also, as an alternative, to have a covering end wall located opposite the covering base 47. The window 55 serves, when the outer pack 10 is open, for the removal of the pack contents directly from the largely closed covering part 12 (FIGS. 17 and 18).

Figure 22:
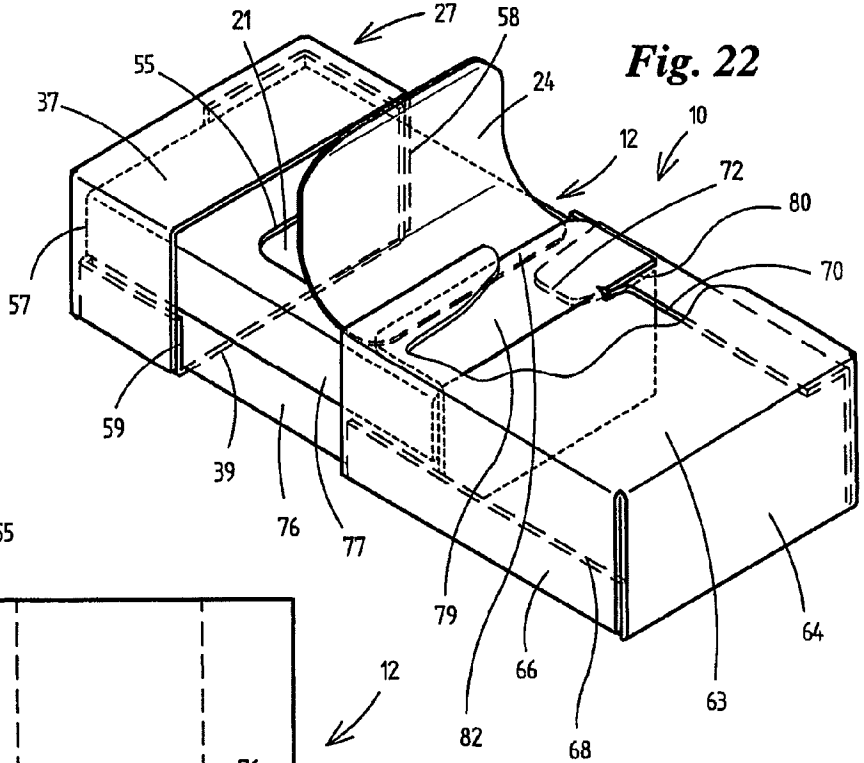
FIG. 22 shows a perspective illustration of a pack according to FIG. 17 with an additional closure means.
Figure 23:
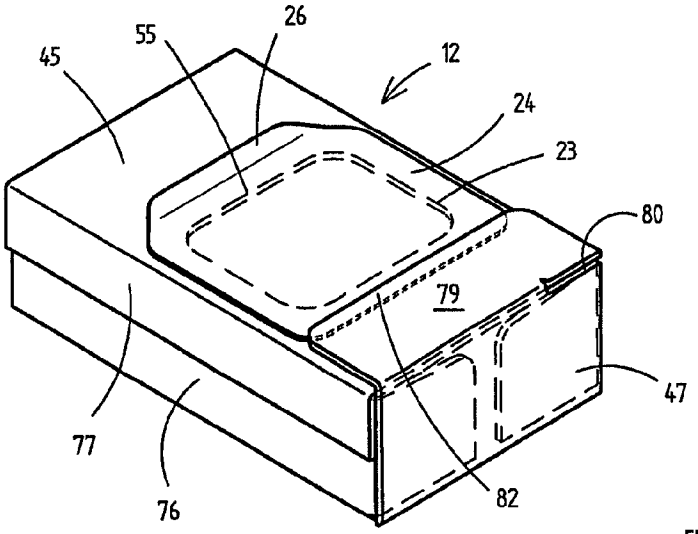
FIG. 23 shows a covering part or a covering sheath as the inner part of the pack according to FIG. 22.
Figure 24:
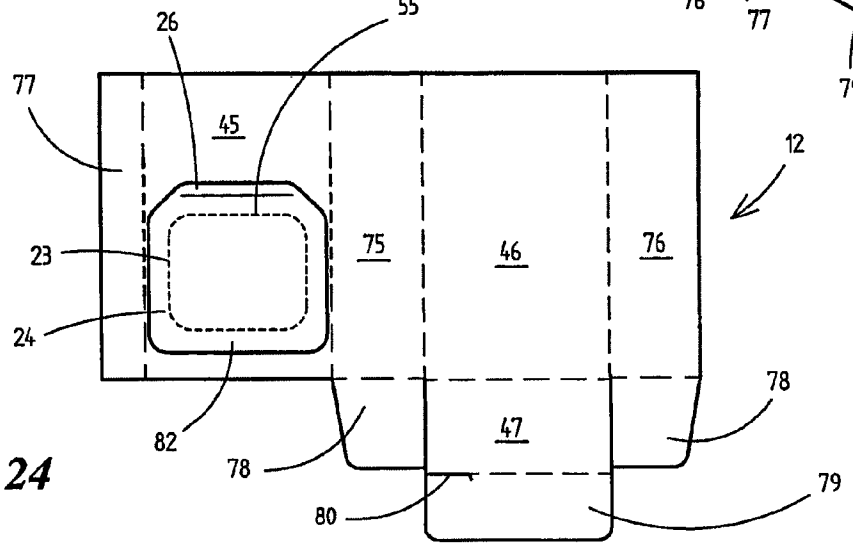
FIG. 24 shows a spread-out blank for a covering sheath according to FIG. 23.

As an alternative, the covering part 12, which forms the inner part of the outer pack 10, may be designed in the manner shown in FIGS. 22 to 24, that is to say with a closure means for the window 55. This closure means is designed here as a closure flap 24 of appropriate dimensioning to cover over the window 55 in full in the closed position. Here too, the grip tab 26 is directed towards the base part 27, but is exposed when the outer pack 10 is open (FIG. 22). On account of the (offset) arrangement of the window 55 in the region of the covering front wall 45, a peripheral strip 82 of the closure flap 24 is arranged in the region of the connecting flap 79 and partially covered over by the latter (FIGS. 22 and 23). This gives rise to the closure flap 24 being additionally fixed in this region, which is located opposite the grip tab 26.

The pack units described are preferably provided with an outer wrapper (not illustrated) which is made of film and is completely or partially removed by means of tear-open strips when the pack units are opened for the first time. Furthermore, the material of the covering part 12 and/or of the outer pack 10 may be specially treated, in particular specially coated, in order to seal in flavor and moisture. Such packaging material is particularly advantageous for embodiments without an inner pack 11.

LIST OF DESIGNATIONS

10 Outer pack
11 Inner pack
12 Covering part
13 Sheet-material bag
14 Closure seam
15 Inner front wall
16 Inner rear wall
17 Inner side wall
18 Inner side wall
19 Inner end wall
20 Inner end wall
21 Removal opening

22 Opening piece
23 Perforation line
24 Closure flap
25 Overlap
26 Grip tab
27 Box part/base part
28 Closure part
29 Lid
30 Side wall
31 Connecting strip
32 Edge
33 Collar
34 Collar front wall
35 Collar side tab
36 Collar depression
37 Box front wall
38 Base wall
39 Box rear wall
40 Lid rear wall
41 End wall
42 Lid front wall
43 Linear articulation
44 Separating line
45 Covering front wall
46 Covering rear wall
47 Covering base
48 Covering end wall
49 Covering side tab
50 Covering side tab
51 Covering side wall
52 Connecting flap
53 Corner tab
54 Corner tab
55 Window
56 Separating line
57 Outer tab
58 Outer tab
59 Inner tab
60 Inner tab
61 Corner tab
62 Corner tab
63 Front wall
64 End wall
65 Rear wall
66 Side tab
67 Side tab
68 Inner side tab
69 Inner side tab
70 Supplementary tab
71 Folding line
72 Nose
73 Punch cut
74 Perforation line
75 Covering side wall
76 Covering side wall
77 Connecting strip
78 Base corner tabs
79 Connecting flap
80 Slot
81 Frame
83 Peripheral strip

What is claimed is:

1. A pack for piece-form or granular pack contents, namely, portions of chewing tobacco or chewing tobacco substitute, comprising:

a) an outer pack (10) made of thin cardboard or similar packaging material the outer pack (10) configured as a hinge-lid pack with a box part (27) and a pivotable lid (29) connected to the box part (27);

b) an inner pack (11) configured as a tubular bag for accommodating the pack contents, the inner pack being made of tight, sealable sheet material, and the inner pack having mutually opposite closure seams (14) designed as fin seams;

c) the inner pack (11) further having an inner front wall (15) and a removal opening (21) that extends exclusively in the region of the inner front wall (15) and which in a closed position is covered by a reusable closure flap (24);

d) an insert comprising a covering part (12) as a separate blank made of thin cardboard or similar packaging material and arranged in the outer pack (10), the covering part (12) at least partially covering the inner pack (11);

e) the covering part (12) comprising: a covering front wall (45) which abuts the inner front wall (15) of the inner pack (11); covering side tabs (49) connected to the covering front wall (45); a covering end wall (48); and a covering rear wall (46);

f) the covering front wall (45) of the covering part (12) comprises an opening in the form of a window (55) in the region of the removal opening (21) of the inner pack (11);

g) the window (55) of the covering front wall (45) is arranged and dimensioned such that the closure flap (24) is arranged in the region of the window (55) and is actuated when the lid (29) of the outer pack (10) is open; and h) the lid (29) of the outer pack (10) and the box part (27) are configured with respect to the dimensions of a lid front wall, on one hand, and a box front wall (37), on the other hand, such that, when the lid (29) is open, the window (55) of the covering front wall (45) and the closure flap (24) for the actuation of the window (55) are exposed.

2. The pack as claimed in claim 1, wherein the covering part (12) is designed as a completely closed sheath that fits, as an inner part, on the outer pack (10), the covering part comprising the covering front wall (45), a covering base (47), the covering end wall (48), the covering side tabs (49, 50), and the covering rear wall (46).

3. The pack as claimed in claim 2, wherein a blank for forming the covering part (12) forms, one beside the other, the covering front wall (45), a covering side wall (75), the covering rear wall (46) and a further covering side wall (76), with a connecting strip (77) at a free periphery of the covering front wall (45) for connection to the further covering side wall (76), with a folding tab being fitted on the covering rear wall (46) for the purpose of forming a covering base (47) with a connecting flap (79).

4. The pack as claimed in claim 2, wherein a blank for the covering part (12) comprises the covering front wall (45), the covering base (47) which adjoins the covering front wall (45), the covering rear wall (46), and the covering end wall (48), with covering side walls (51) being formed from mutually overlapping and interconnected covering side tabs (49, 50) and the covering end wall (48) being connected to the covering front wall (45) via a connecting flap (52).

5. A pack for piece-form or granular pack contents, namely, portions of chewing tobacco or chewing tobacco substitute, comprising:

a) an outer pack (10) designed as a slide-type box, made of thin cardboard or similar packaging material, having a cup-like base part (27) and a sleeve-like closure part (28) that is displaceable relative to the cup-like base part (27);

b) an inner pack (11) configured as a tubular bag for accommodating the pack contents, the inner pack (11) being made of tight, sealable sheet material, the inner pack (11) having mutually opposite closure seams (14) designed as fin seams;

c) the inner pack (11) further having an inner front wall (15) and a removal opening (21) that extends exclusively in the region of the inner front wall (15) and which in a closed position is covered by a reusable closure flap (24);

d) the base part (27) of the outer pack (10) is connected to an insert or covering part (12) that comprises at least covering front wall (45), a covering rear wall (46), covering side walls (51), and a covering end wall (48) and/or a covering base wall (47), the insert or the covering part (12) which surrounds the inner pack (11);

e) the closure part (28) is displaceable on the insert or covering part (12) between a closed position, in which the closure part (28) butts against the base part (27), and an open position, which is remote from the base part (27);

f) the covering front wall (45) of the insert or covering part (12) extends in the region of the inner front wall (15) of the inner pack (11) such that the inner front wall (15) with the removal opening (21) is covered by the covering front wall (45);

g) the covering front wall (45) has a window (55) opening that is exposed, when the closure part (28) is open, in the region between a box front wall (37) of the base part (27) and a front wall (63) of the closure part (28); and h) the window (55) of the covering front wall (45) is arranged in the region of the removal opening (21) of the inner pack (11) and of the closure flap (24) such that the closure flap (24) is actuated by means of the window (55) of the covering front wall (45) when the outer pack is open.

6. The pack as claimed in claim 5, wherein the covering part (12) is of cup-like design that is closed apart from one open end side, the open end side of the covering part (12) being covered by an associated end wall (64) of the outer pack (10).

7. The pack as claimed in claim 5, wherein the covering part (12) is designed as a completely closed sheath that fits, as a separate inner part, in the outer pack (10), the covering part comprising the covering front wall (45), the covering base (47), the covering end wall (48), covering side tabs (49, 50), and the covering rear wall (46).

8. The pack as claimed in claim 7, wherein a blank for the covering part (12) comprises the covering front wall (45), the covering base (47) which adjoins the covering front wall (45), the covering rear wall (46), and the covering end wall (48), with covering side walls (51) being formed from the covering side tabs (49, 50) which are mutually overlapping and interconnected, and the covering end wall (48) being connected to the covering front wall (45) via a connecting flap (52).

9. The pack as claimed in claim 5, wherein:

a) the outer pack (10) comprises a cup-like base part (27) and a sleeve-like closure part (28) that is displaceable relative to the cup-like base part (27);

b) the insert or covering part (12) comprises at least the covering front wall (45), the covering rear wall (46), the covering side walls (51), the covering end wall (48), and the covering base wall (47), and is connected to the base part (27) of the outer pack (10);

c) the closure part (28) is displaceable on the insert or covering part (12) between a closed position, in which the closure part (28) butts against the base part (27), and an open position, which is remote from the base part (27);

d) the covering front wall (45) comprises a window (55) opening that is exposed when the closure part (28) is open, in the region between a box front wall (37) of the base part (27) and a front wall (63) of the closure part (28); and e) the closure flap (24) is arranged on the covering front wall (45) in the region of the window (55), wherein the closure flap (24) covers the window (55) and that, for the purpose of opening the window (55), is pulled off from the covering front wall (45) in full or in part by a connection by means of permanent adhesive.

10. The pack as claimed in claim 9, wherein the closure part (28) is secured in the open position by a tongue or nose (72) stop that is fitted on the inside of the outer pack (10) or of the closure part (28) and butts against a folding tab of the covering part (12) in the open position.

11. The pack as claimed in claim 9, wherein the covering base wall (47) is connected to the covering rear wall (46) and against a free side of which butts a connecting flap (79) that, when the insert or covering part (12) has been fitted, butts against the outside of the covering front wall (45) and is connected thereto, with a folding edge formed between the covering base wall (47) and the connecting flap (79) serving as a stop for a nose (72) stop that is fitted on the closure part (28).

12. The pack as claimed in claim 11, wherein the connecting flap (79) covers over a peripheral strip of the closure flap (24) that is remote from a grip tab (26) of the closure flap (24).

13. The pack as claimed in claim 7, wherein a blank for forming the covering part (12) forms, one beside the other, the covering front wall (45), a covering side wall (75), a covering rear wall (46) and a further covering side wall (76), with a connecting strip (77) at a free periphery of the covering front wall (45) for connection to the further covering side wall (76), with a folding tab being fitted on the covering rear wall (46) for the purpose of forming a covering base (47) with a connecting flap (79).

* * * * *